US006652340B2

(12) United States Patent
Mollin

(10) Patent No.: US 6,652,340 B2
(45) Date of Patent: Nov. 25, 2003

(54) SURFBOARD AND METHOD FOR ITS MANUFACTURE

(76) Inventor: Jack Mollin, 44796 Corte Hidalgo, Temecula, CA (US) 92592

( * ) Notice: Subject to any disclaimer, the term of this patent is extended or adjusted under 35 U.S.C. 154(b) by 0 days.

(21) Appl. No.: 10/104,763

(22) Filed: Mar. 22, 2002

(65) Prior Publication Data

US 2002/0137408 A1 Sep. 26, 2002

Related U.S. Application Data

(60) Provisional application No. 60/277,780, filed on Mar. 22, 2001.

(51) Int. Cl.[7] ..... B63B 35/79
(52) U.S. Cl. ..... 441/74
(58) Field of Search ..... 441/74

(56) References Cited

U.S. PATENT DOCUMENTS 5,145,430 A 9/1992 Kays et al.
5,295,883 A 3/1994 Moran
5,489,228 A 2/1996 Richardson et al.
5,816,876 A * 10/1998 Hamilton ..... 441/74
6,066,016 A * 5/2000 Yonover ..... 441/40

* cited by examiner

*Primary Examiner*—Jesus D. Sotelo
(74) *Attorney, Agent, or Firm*—Edward A. Sokolski

(57) ABSTRACT

A surfboard is formed from a pair of lightweight shell elements which may be of a polycarbonate which is see through, plexiglass or other material having a high strength and low weight. The two shell elements are joined together to form an airtight and water tight sealed hollow unit. The shaping of the shell elements is in accordance with conventional surfboard requirements and the tail and nose are made removable so that these components can be substituted to satisfy various surfing requirements. A pressure valve is provided for injecting pressurized air into the interior of the shell and through way valves are provided for the nose and tail to allow the nose and tail parts to maintain the same pressure as the main body. The outer surface of the board may be coated with a sticker vinyl material

7 Claims, 6 Drawing Sheets

SURFBOARD AND METHOD FOR ITS MANUFACTURE

This application is based on Provisional application Ser. No. 60/277,780 filed by Jack Mollin on Mar. 22, 2001.

BACKGROUND OF THE INVENTION

1. Field of the Invention

This invention relates to surfboards and more particularly a surfboard formed in a hollow configuration.

2. Description of the Related Art

Most prior art surfboards are fabricated with a polyurethane foam core known as the "blank" which is cut in the general shape of the board. The shaping is done in a custom design by trimming edges and carving curved portions in the blank. The blank is then wrapped with fiberglass and sanded and painted with a resin gloss material. The resin produces volatile organic compounds which requires a toxic catalyst (MEKP) for curing. Prior art boards are described in U.S. Pat. No. 5,295,883, issued Mar. 22, 1994 to Moran; U.S. Pat. No. 5,145,430, issued Sep. 8, 1992 to Keys et al.; and U.S. Pat. No. 5,489,228, issued Feb. 6, 1996 to Richardson, et al. The device in Richardson utilizes stiffening cores which are covered over with resilient exterior layers. In Moran, the core is described as being fabricated of crosshatched fiber mesh while in Richardson, it is described as being of a solid lightweight material. In none of these prior art devices is it suggested to fabricate the board from two half shells which are joined together to form an air tight and water tight hollow shell which may be pressurized with air. As already noted, with the prior art methods of manufacture wherein a resin gloss is painted on a fiberglass surface, toxic resins and ozone harming solvents are generated which are environmentally undesirable. Further, most prior art boards are solid in configuration which makes for heavier weight than a hollow shell.

SUMMARY OF THE INVENTION

The surfboard and method for its manufacture of the present invention overcomes the shortcomings of the prior art by obviating the need for a resin gloss and thus avoiding the environmentally undesirable results of using this substance. Further, in an improved embodiment of the invention, the use of a solid interior between the two halve pieces of the board is eliminated and rather a hollow center is employed with the two halves of the board being joined together in air tight and water tight relationship. The interior of the board is then pressurized with air. Utilizing a material for the two halves of the board of a hard highly durable lightweight polycarbonate material in conjunction with a hollow structure makes for lighter weight than prior art boards, while the air pressurization employed greatly increases the board's buoyancy.

It is therefore an object of this invention to provide a surfboard having vastly improved characteristics; It is a further object of this invention to provide a surfboard which is of higher strength, lighter weight, and greater buoyancy.

It is still a further object of this invention to provide a method for manufacturing a surfboard in which the generation of environmentally undesirable elements is avoided.

Other objects of the invention will become apparent from the following description in conjunction with the accompanying drawings.

Figure 1:
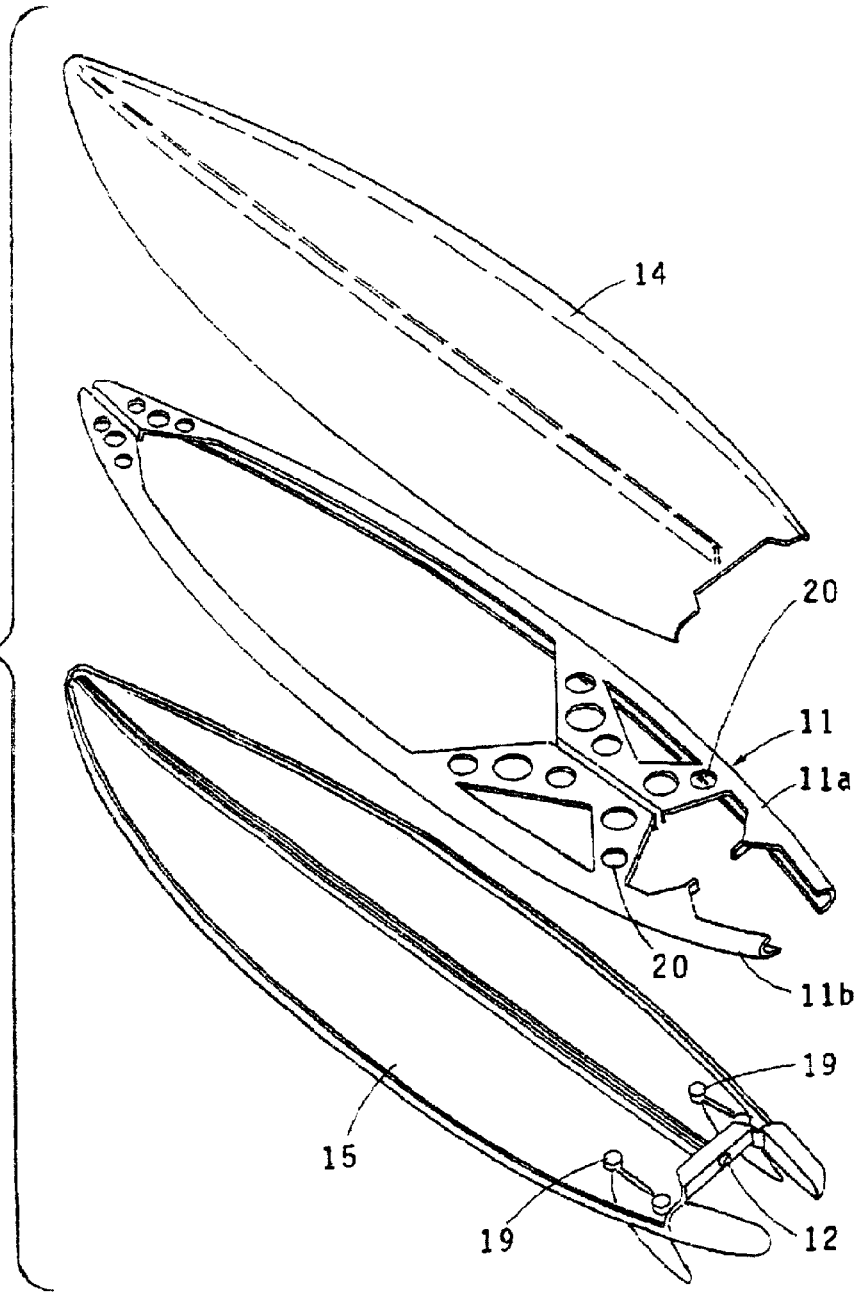
FIG. 1 is an exploded perspective view of a first embodiment of the invention.
Figure 2:
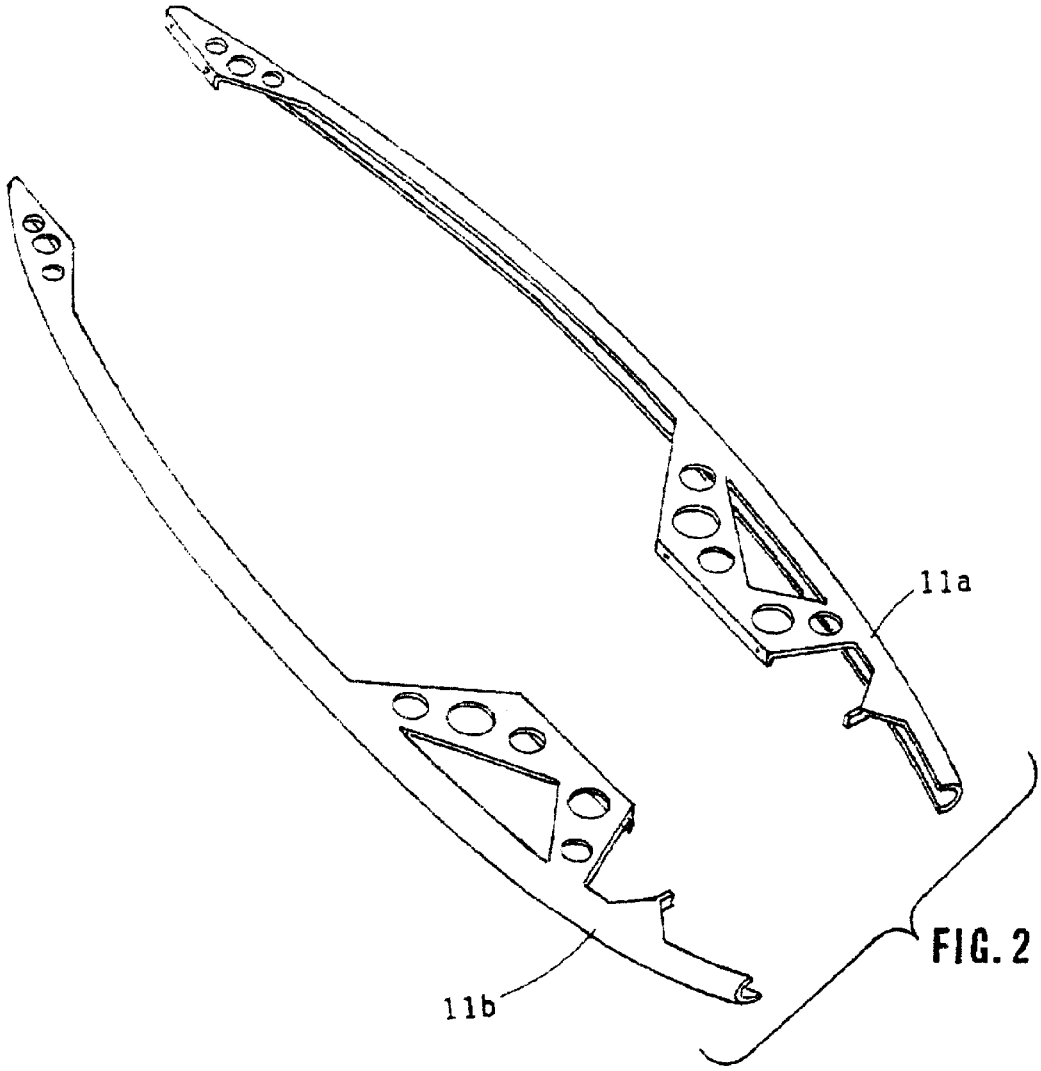
FIG. 2 is a top perspective view of the central sub frame of the first embodiment.
Figure 3:
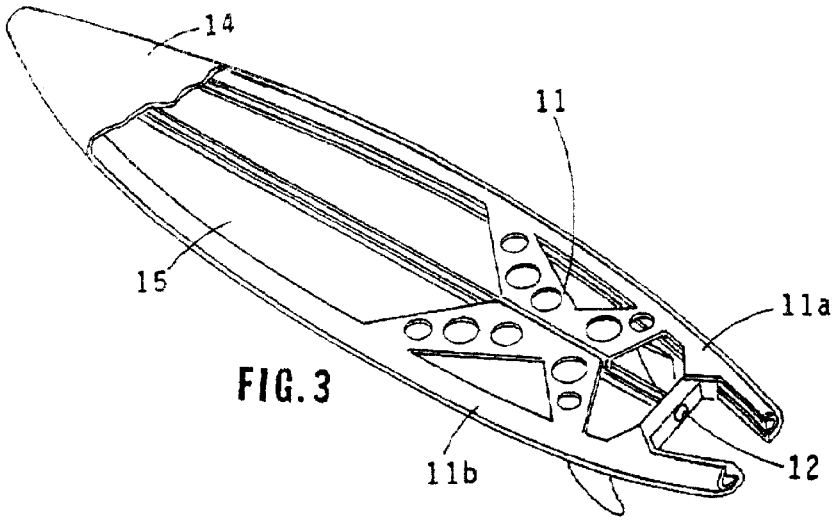
FIG. 3 is a top perspective view with cutaway section of the first embodiment.
Figure 3A:
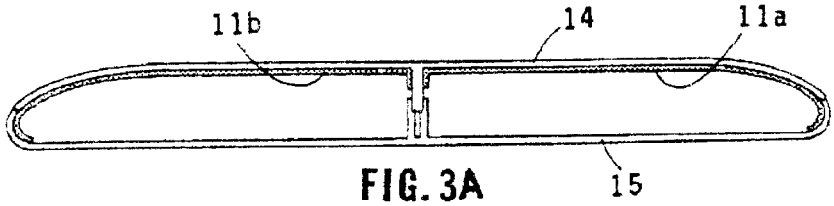
FIG. 3A is a cross sectional view of the first embodiment.

invention is shown. The shell of the board is formed from two similar sections 14 and 15 which are brought together at their edges and these edges bonded to each other with hermetic sealing or other suitable means. Contained within the shell formed by sections 14 and 15 is a central base frame 11 of a lightweight material such as aluminum or a plastic material. The edges of the frame 11*a* and 11*b* are bonded to the edges of shell sections 14 and 15 so that the central frame is encased within the shell.

Posts 19 which fit through holes 20 are employed to help hold the shell sections and the central frame together. A pressure nozzle 12 is provided in shell section 15 for use in variously pressurizing the center of the board with air to attain different levels of buoyancy.

Figure 4:
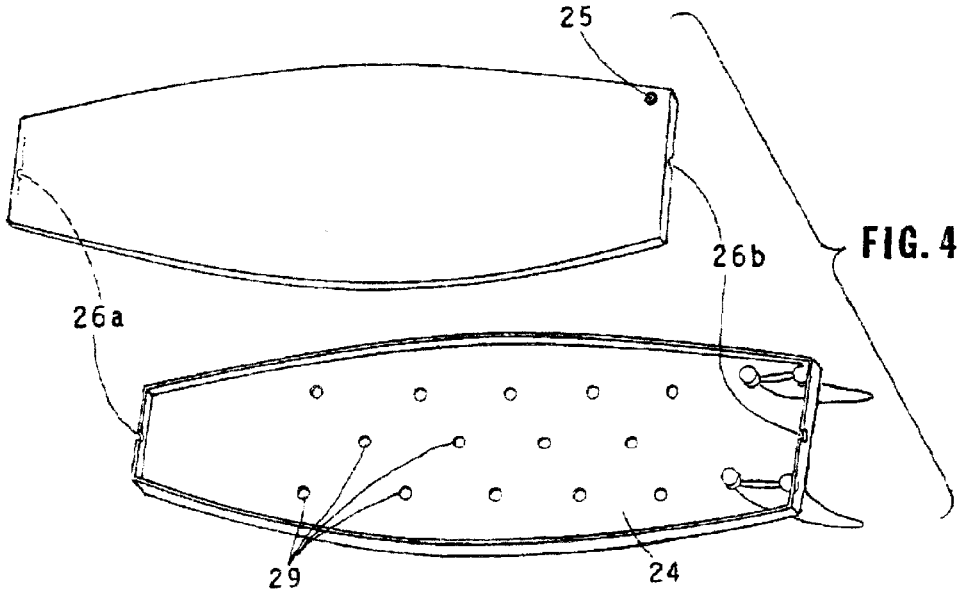
FIG. 4 is a top plan exploded view of a preferred second embodiment of the invention.
Figure 5:
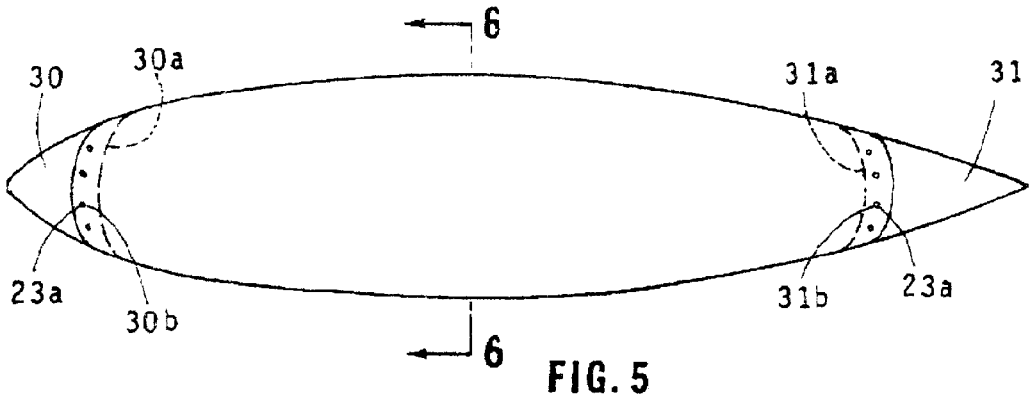
FIG 5 is a top plan view of the preferred embodiment.
Figure 6:
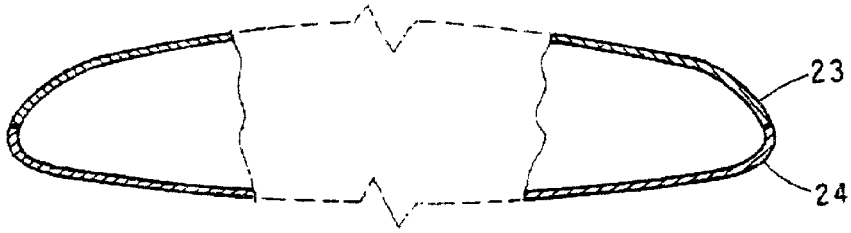
FIG. 6 is a cross sectional view taken along the plane indicated by 6—6 in FIG. 5.

Referring now to FIGS. 4—6, a preferred embodiment of the invention is illustrated. Top shell portion 23 and bottom shell portion 24 are preferably fabricated of a polycarbonate which is a see through material or plastic with a glass like appearance. Such material is available, among other sources, from the Bayer Company, Pittsburgh, Pa. The shell portions are joined together along their edges to form an air tight and water tight hollow shell as shown in FIGS. 6 and 6A. An air pressure valve 25 is provided for use in pressurizing the interior of the shell as may be desired. Through way air valves 26*a* and 26*b* located at the nose and tail of the board assure that the nose and tail parts maintain the same pressure as each other and as the main shell body.

The surfaces of the board are coated with a commercially available vinyl sticker material which is rolled on. Holes 29 are formed in the surface of the bottom half shell, these holes being covered over by the vinyl sticker.

The vinyl surface can be made to have various thicknesses on different parts of he board making for ridges and valleys in the board surface which can be used as indentations for the upper chest, rib cage, knees, front handgrip, etc. The holes 29 lighten the board, the holes being covered by the vinyl sticker to maintain an air tight and water tight condition. As shown in FIG. 5, hollow sealed nose piece 30 and tail piece 31, which are selectively chosen to satisfy different surfing requirements of the user and the surfing conditions are removably attached to the main board and can be readily replaced with different types of units. The nose and tail pieces have lips 30*a* and 31*a* formed on their ends, these lips having apertures formed therein in which snap members 30*b* and 31*b* are installed. Holes 23*a* which are located to match the snap members are formed through the board. Latch members to mate with the snap members are installed in holes 23*a*, the lips thus being joined to the underside of the main body of the board.

Figure 7:
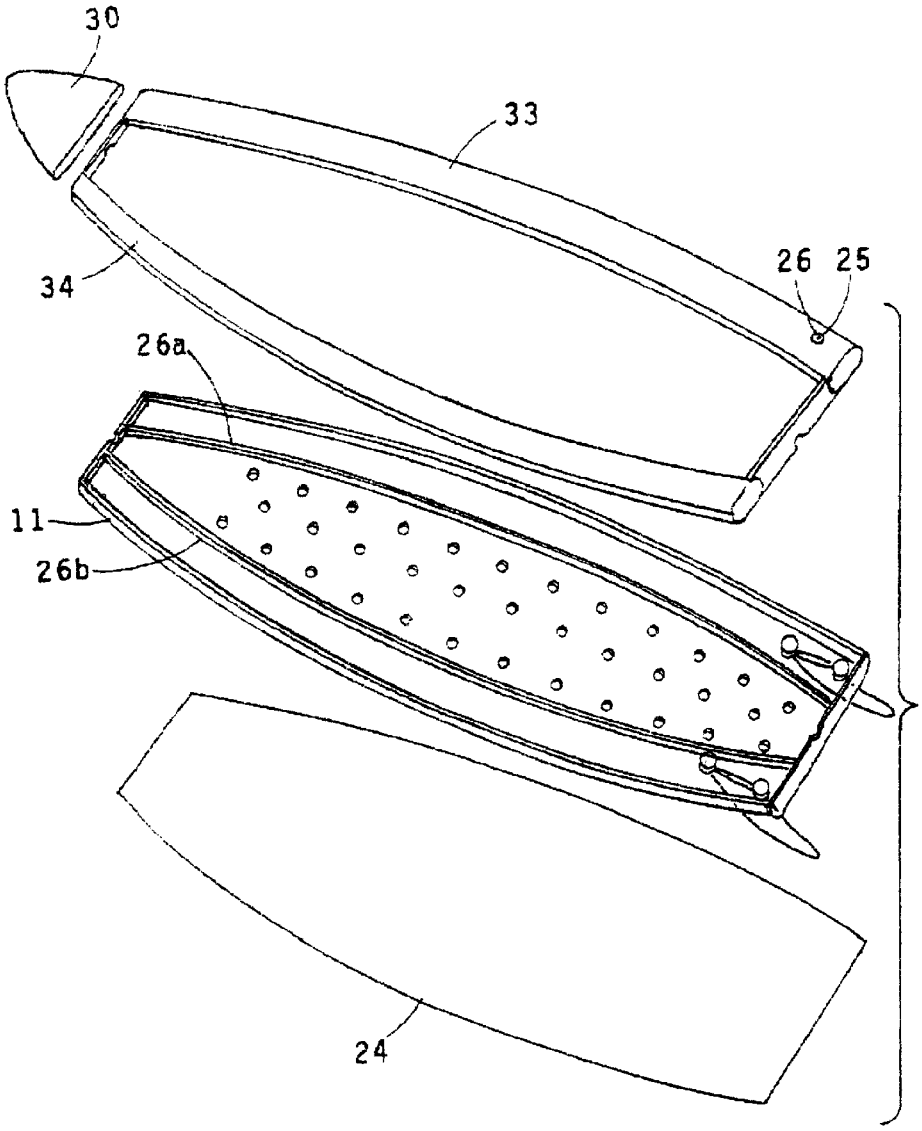
FIG. 7 is a top exploded view of a further embodiment of the invention.
Figure 8:
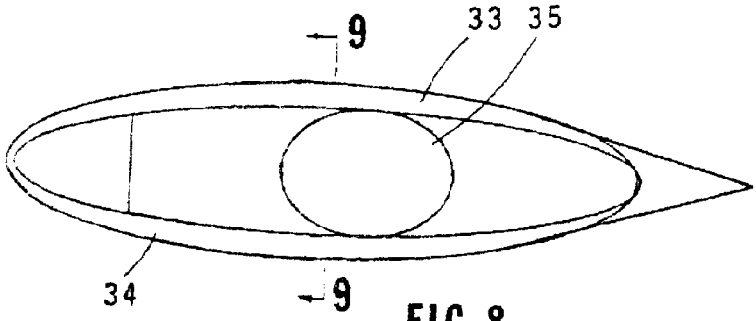
FIG. 8 is a top plan view of the embodiment of FIG. 7.
Figure 9:
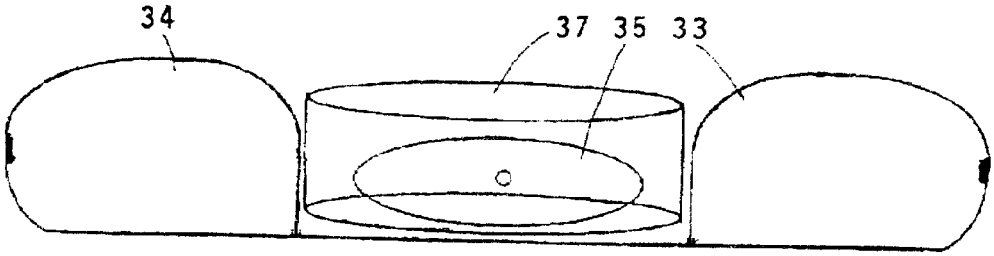
FIG. 9 is a cross sectional view taken along the plane indicated by 9—9 in FIG. 8.

Referring now to FIGS. 7–9, a further embodiment of the invention is show. In this embodiment, the top board 23 has tubes 33 and 34 on its opposite sides, which are sealed and carry pressurized air fed in through pressure valve 25. A foot pad 35 is provided in the center of bottom board 24. As for the previous embodiment, through valves 26*a* and 26*b* are provided for the nose and tail units. Tubes 33 and 34 are provided on the opposite sides of the board, these tubes being pressurized with air. An inflatable bladder 37 is installed around the foot pad to increase buoyancy.

While the device has been described and illustrated in detail, this is intended by way of illustration and example only and not by way of limitation, the spirit and scope of the invention being limited only by the terms of the following claims.

I claim:

1. A surfboard comprising a first shell section forming the top of said surfboard and a second shell section forming the bottom of said surfboard, said shell sections being joined together along their edges to form an air tight and water tight shell;

hollow nose and tail units removably attached to the nose and tail of said shell respectively;

An air channel interconnecting the nose and tail units; and an air pressure valve for use in feeding pressurized air into the interior of said shell.

2. The device of claim 1 and further including holes formed in the second shell section and a vinyl sticker coating covering the entire shell and sealing said holes.

3. The device of claim 1 wherein said first shell section is formed by a pair of air tight and water tight tubular members attached in opposing relationship and running along opposite sides of said second shell section.

4. The device of claim 3 and further including a foot pad attached to said second shell section between said tubular members.

5. A method for constructing a surfboard comprising the steps of:

forming first and second shell sections of a plastic material, said first shell section having an outer surface in the configuration of the top of a surfboard, said second shell section having an outer surface in the configuration of the bottom of a surfboard;

Joining said shell sections together along their edges to form an air tight and water tight shell;

forming nose and tail portions of said surfboard separately from said shell, said nose and tail portions being removably attached to said shell; and Coating the surfaces of said shell with a vinyl sticker material.

6. A method for constructing a surfboard comprising the steps of:

forming first and second shell sections of a plastic material, said first shell section having an outer surface in the configuration of the top of a surfboard, said second shell section having an out surface in the configuration of the bottom of a surfboard;

Joining said shell sections together along their edges to form an air tight and water tight shell;

Forming holes in the surface of said second shell section and sealing said holes with vinyl sticker material; and Coating the surfaces of said shell with a vinyl sticker material.

7. A method for constructing a surfboard comprising the steps of;

forming first and second shell sections of a plastic material, said first shell section having an outer surface in the configuration of the top of a surfboard, said second shell section having the configuration of the bottom of a surfboard, said first shell section being formed by a pair of tube members attached to said second shell section in opposition to each other along opposite sides of said second shell section;

Joining said shell sections together along their edges to form an air tight and water tight shell; and Coating the surfaces of said shell with a vinyl sticker material.

* * * * *